US005915360A

United States Patent [19]

Ishiwata et al.

[11] Patent Number: 5,915,360

[45] Date of Patent: Jun. 29, 1999

[54] SPILL CONTROL APPARATUS FOR FUEL INJECTION SYSTEM

[75] Inventors: Hiroshi Ishiwata; Jun Matsubara; Kenichi Kubo; Noriyuki Abe; Katsuhiro Shimokoshikimachi, all of Higashimatsuyama, Japan

[73] Assignee: Zexel Corporation, Tokyo, Japan

[21] Appl. No.: 09/052,677

[22] Filed: Apr. 1, 1998

[30] Foreign Application Priority Data

Apr. 3, 1997 [JP] Japan ..... 9-101007

[51] Int. Cl.[6] ..... F02M 37/04

[52] U.S. Cl. ..... 123/450; 123/506

[58] Field of Search ..... 123/506, 450, 123/500, 501, 449; 417/462

[56] References Cited

U.S. PATENT DOCUMENTS

| | | | |
|---|---|---|---|
| 3,489,092 | 1/1970 | Thomson | 123/450 |
| 4,587,990 | 5/1986 | Schmid | 123/449 |
| 4,708,114 | 11/1987 | Guntert | 123/449 |
| 5,619,971 | 4/1997 | Kubo | 123/450 |
| 5,641,224 | 6/1997 | Kubo | 123/450 |
| 5,642,715 | 7/1997 | Yamakawa | 123/450 |
| 5,647,323 | 7/1997 | Kubo | 123/450 |

*Primary Examiner*—Carl S. Miller

*Attorney, Agent, or Firm*—Wenderoth, Lind & Ponack, L.L.P.

[57] ABSTRACT

In a spill control apparatus for a fuel injection system in which a sleeve is externally fitted to a rotor, and the position of the sleeve relative to the rotor is used to adjust the communication timing between a port on the rotor and a port on the sleeve, the port formed at the rotor is constituted of a first indented portion formed over a specific angle of rotation and a second indented portion formed to achieve specific spill characteristics. The second indented portion is formed continuous to the front end of the first indented portion in the direction of rotation and the contour of the second indented portion is continuous to the contour of the first indented portion which is constituted of oblique sides which extend toward the front relative to the direction of rotation. The length of the rotor port in the axial direction may be set smaller than the length of the port formed on the sleeve in the axial direction. Thus, it is possible to inhibit the entry of dust particles into the area between the rotor and the sleeve, reducing the incidence of scarring induced on the sliding contact surfaces of the rotor and sleeve, and preventing the seizure of the rotor and the sleeve.

17 Claims, 5 Drawing Sheets

SPILL CONTROL APPARATUS FOR FUEL INJECTION SYSTEM

BACKGROUND OF THE INVENTION

1. Field of the Invention

The present invention relates to a spill control apparatus for a fuel injection system, in which a sleeve is externally fitted to a rotor and the position of the sleeve relative to the rotor is used to adjust the communication timing with which a port at the rotor and a port at the sleeve come into communication with each other. More specifically, the present invention is adopted in distributor type fuel injection systems in which a rotor that rotates in synchronization with an engine is fitted with plungers that are radially slidable, and the plungers are caused to make reciprocal movement by a cam ring, to vary the volumetric capacity of the compression space formed at the rotor.

2. Description of the Related Art

In the known art, inner-cam type fuel injection systems characterized in that ports are formed at a rotor and a sleeve externally fitted to the rotor include, for instance, the one disclosed in Japanese Unexamined Patent Publication No. S60-79152 and the one disclosed in Japanese Unexamined Patent Publication No. H8-270521.

In the former system, a concentric inner-cam (cam ring) is provided around a rotating fuel distribution member (rotor) and force-feed plungers are provided at the cam surfaces formed on the inside of this inner-cam via rolling elements or the like, to cause the force-feed plungers to move reciprocally in a radial direction relative to the rotating fuel distribution member. The rotating fuel distribution member is provided with, a pump chamber (compression space) whose volumetric capacity is varied by the force-feed plungers, an intake port to take fuel into the pump chamber during the intake process, a distribution port for delivering the fuel pressurized in the pump chamber during the force-feed phase and spill ports for cutting off fuel delivery The spill ports are formed with a ring-like member (control sleeve) which covers the cutoff port externally fitted on the rotating fuel distribution member.

A reed-like groove is provided on the internal circumferential surface of the ring-like member or the external circumferential surface of the rotating fuel distribution member. By forming a spill start edge which is inclined relative to the generating line at the reed-like groove and causing the ring-like member to move in the axial direction of rotating member, the spill start timing (cutoff timing) is varied, to allow the injection amount to be varied.

The latter, which is an inner-cam type fuel injection system, has a structure basically identical to that of the former system, with a control sleeve externally fitted to the distribution member and timing with which inflow/outflow ports (rotor ports) formed in the distribution member and intake/cutoff ports (sleeve ports) formed in the control sleeve come into communication can be varied by relatively displacing the control sleeve in the axial direction. In this fuel injection system, each of the communication start edges at the inflow/outflow ports and the intake/cutoff ports is constituted by the oblique side that is inclined in the axial direction. In particular, the length of the intake/cutoff ports (sleeve ports) in the axial direction is shorter than the length of the inflow/outflow ports (rotor ports) in the axial direction.

Forming a spill start edge on an incline as in the former example is known in the prior art, and because this spill start edge determines the amount of fuel to be injected, it must be machined to a high degree of precision. However, the formation of an edge with satisfactory precision cannot be guaranteed by merely creating an indented groove on the internal circumferential surface of the ring-like member or the external circumferential surface of the rotating fuel distribution member to form a spill start edge as described above. Therefore, the inventor of the present invention has been studying structures that are formed by superimposing a reed-like indented portion 52 (second indented portion) for cutoff, upon the pond-like indented portion 51 (first indented portion).

Such a reed-like indented portion 52 is formed by cutting a groove of a specific width that is inclined relative to the shaft center as shown in FIG. 6B, using a circular cutter or the like. However, when this is formed arbitrarily, i.e. without consideration for its relation with the existing pond-like indented portion 51, scars 55 may result on the sliding contact surfaces of the rotating member 53 and the sleeve 54, or the rotating member 53 and the sleeve 54 may become seized.

Based on their research and investigations, the inventors of the present invention have discovered that if an end portion 52*a* of the reed-like indented portion 52, which is to the rear in the direction of rotation, protrudes from the pond-like indented portion 51 and a corner 56 which progressively narrows toward the rear relative to the direction of rotation is formed at this reed-like indented portion 52, fine dust particles 57 are likely to collect at this corner 56. In addition, because the reed-like indented portion 51 is oriented upward in the shape of an arc with its cutting start and cutting finish end cut are cut by a circular cutter (see FIG. 6B), the dust particles 57 which have collected in the corner portion are guided to the space between the rotating member 53 and the sleeve 54, increasing the likelihood of the sliding surfaces becoming scarred or seized.

As long as the reed-like indented portion is shaped in such a manner that the dust particles have a tendency to move toward the sliding contact surface, in order to avoid seizure, the clearance between the rotating member 53 and the sleeve 54 cannot be reduced, which, in turn, makes it difficult to increase the fuel injection pressure and stabilize fuel injection at low speed.

Also, in the latter example, because the inflow/outflow ports 31 (rotor ports) formed on the distribution member 8 are longer in the axial direction than the intake/cutoff ports 35 (sleeve ports) formed at the control sleeve 34 as shown in FIG. 7, the range over which the intake/cutoff ports 35 communicates with the inflow/outflow ports 31 is limited to the range ($\delta$) of the intake/cutoff ports 35, as shown in FIG. 8. The ranges ($\epsilon$) over which the intake/cutoff port 35 is not present form pockets of space that are blocked by the internal circumferential surface of the control sleeve 34 (the area shown in diagonal lines), causing the compressed fuel to swirl in this blocked-off space. This in turn causes dust particles to collect in the blocked-off area and these dust particles is drawn into the gap between the distribution member 8 and the control sleeve 34, scarring their sliding contact surfaces and inducing seizure of the distribution member 8 and the control sleeve 34 in a manner similar to that described above.

SUMMARY OF THE INVENTION

Accordingly, since the problems described above are caused by the shapes of the ports opening at the sliding contact surfaces of the rotor and the sleeve, an object of the present invention is to provide a spill control apparatus for fuel injection systems in which scars induced on the sliding contact surfaces of the rotor and sleeve are reduced, and seizure of the rotor and sleeve is prevented, eliminating these problems. Another object of the present invention is to reduce the clearance between the rotor and the sleeve by inhibiting the entry of dust particles between the two, thereby improving injection performance.

In order to achieve the objects described above, in the spill control apparatus for a fuel injection system according to the present invention a sleeve externally fitted slidably at a rotor, a force feed fuel passage for supplying compressed fuel to a discharge port and rotor ports connected to this force feed fuel passage and opening onto the circumferential surface of the rotor which is covered by the sleeve, are formed at the rotor. Sleeve ports are formed on the sleeve and are capable of communicating with the rotor ports and the communication timing for the rotor port and the sleeve ports is adjusted by the displacement of the sleeve relative to the rotor. A first indented portion that communicates with a port at the other side over a specific angle of rotation and a second indented portion formed in such a manner that specific spill characteristics are obtained are provided at each port either at the rotor side or the sleeve side. The second indented portion is formed continuous to the front end of the first indented portion in the direction in which the rotor and sleeve rotate relative to each other, and the contour of the second indented portion continuous to the contour of the first indented portion is constituted of the side extending toward the front side relative to the direction of rotation.

The first and second indented portions can be formed at the external circumferential surface of the rotor or at the internal circumferential surface of the sleeve, and the first indented portion and second indented portion can basically be formed in any shape, although it is preferable to form the second indented portion as an inclined groove having a specific width, since the cutoff timing must be adjusted precisely through displacement of the sleeve relative to the rotor.

In order to constitute the contour of the second indented portion continuous to the contour of the first indented portion with a side extending toward the front relative to the direction in which the rotor and sleeve rotate relative to each other, a structure in which the contour of the reed-like indented portion 25 continuous to the contour of the pond-like indented portion 24 does not turn back to the rear side relative to the direction of rotation and the front end is reached only by oblique sides 29*a* and 29*b* that are continuous toward the front relative to the direction of rotation as shown in FIG. 2A, and to avoid structures such as that illustrated in FIG. 6A, in which the contour of the reed-like indented portion 52 comprises oblique side 58*a*, which turns back to the rear side relative to the direction of rotation, and oblique sides 58*b* and 58*c* which continue toward the front relative to the direction of rotation, creating a corner 56 which progressively narrows toward the rear relative to the direction of rotation.

Therefore, because all areas of the second indented portion are formed by lines that extend toward the front relative to the direction of rotation from the first indented portion, any dust particles that enter the second indented portion does not remain in the second indented portion, but moves to the rear side relative to the direction of rotation and into the first indented portion, reducing the frequency of dust particles entering the space between the rotor and the sleeve.

Also, to achieve a similar object, it is preferable that the length in the axial direction of the rotor ports on the external circumferential surface of the rotor be shorter than the length in the axial direction of the sleeve ports on the internal circumferential surface of the sleeve.

In this case, the length of the sleeve ports on the internal circumferential surface of the sleeve in the axial direction is set at a length that will include the path of a rotor port, regardless of the displacement of the sleeve relative to the rotor.

Thus, since the locus of the rotor port lies within the range of the sleeve port, thereby exposing the entire rotor port to the sleeve ports as the rotor rotates and no blocked areas are created on parts of the rotor port, as was the case in the prior art, even when compressed fuel spills with dust particles mixed in the fuel, it can be discharged quickly through the sleeve port, inhibiting the entry of the dust particles into the area between the rotor and the sleeve.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiment. In the drawings.

DETAILED DESCRIPTIONS OF THE PREFERRED EMBODIMENT

Figure 1:
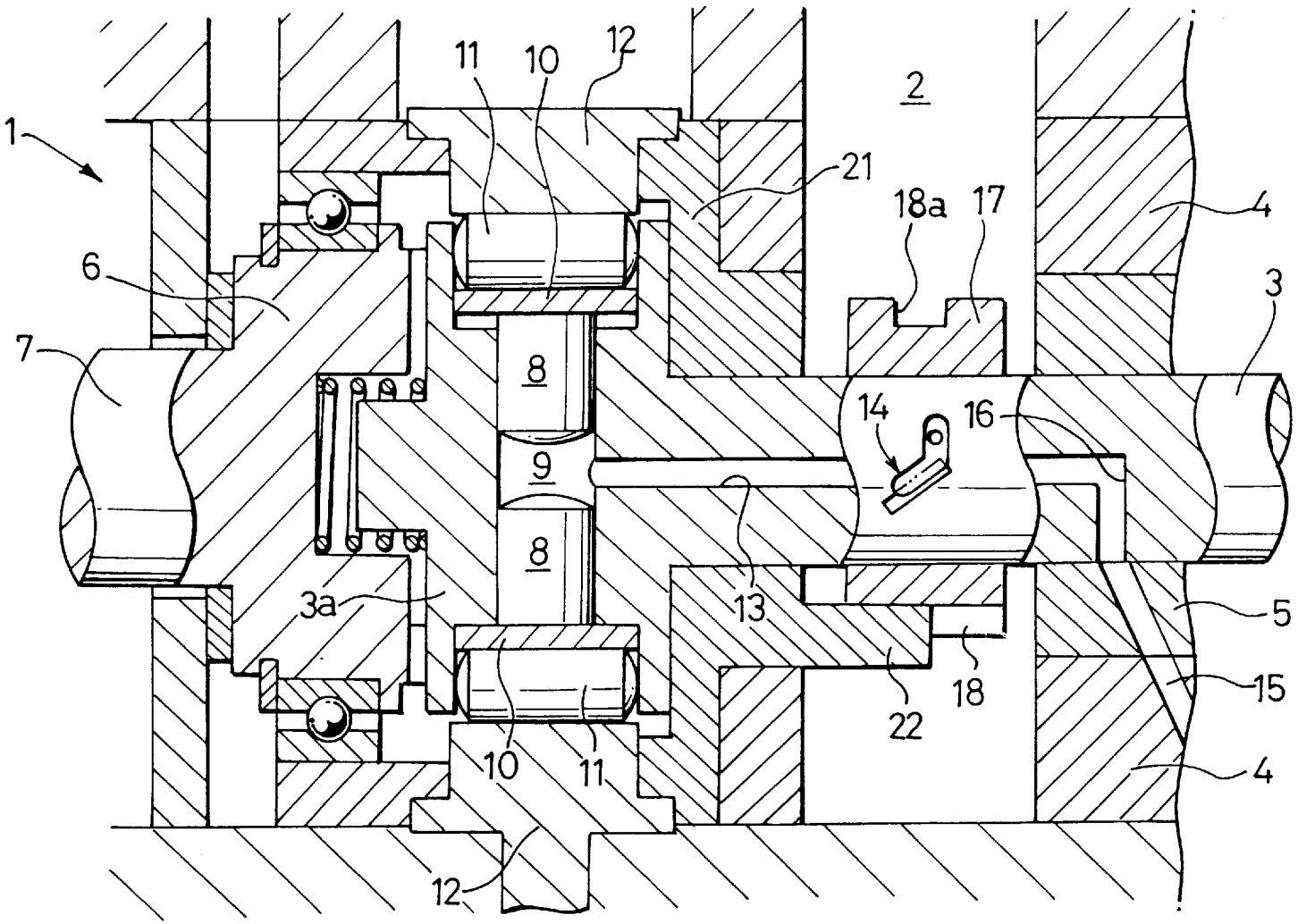
FIG. 1 is a cross section showing an essential portion of a VR distributor type fuel injection system according to the present invention.

The following is an explanation of the preferred embodiments of the present invention in reference to the drawings. In FIG. 1, which illustrate an essential portion of a distributor type fuel injection system adopting an inner cam system, the distributor type fuel injection system 1 is provided with a chamber 2 into which a fuel is guided via a feed pump (not shown), a rotor 3 which intersects the chamber 2 and is rotatably inserted at a barrel 5 secured to a pump housing 4. A base end portion 3*a* of the rotor 3 is linked to a drive shaft 7 via a coupling 6 so that it is only allowed to rotate in synchronization with the engine. In addition, plungers 8 are slidably inserted at the base end portion 3*a* of the rotor 3 in the direction of the radius (in the radial direction).

Figure 2A:
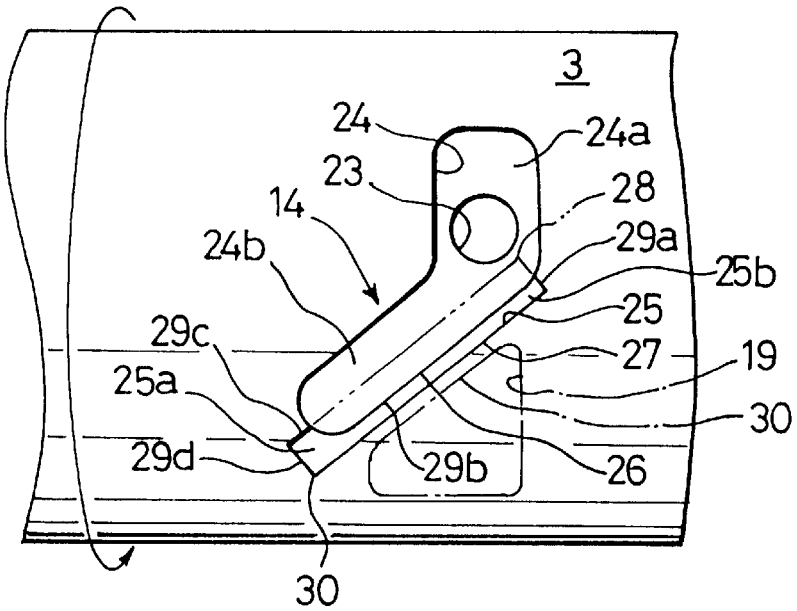
FIGS. 2A and 2B are enlargement showing the area of an inflow/outflow port of the fuel injection system shown in FIG. 1.
Figure 2B:
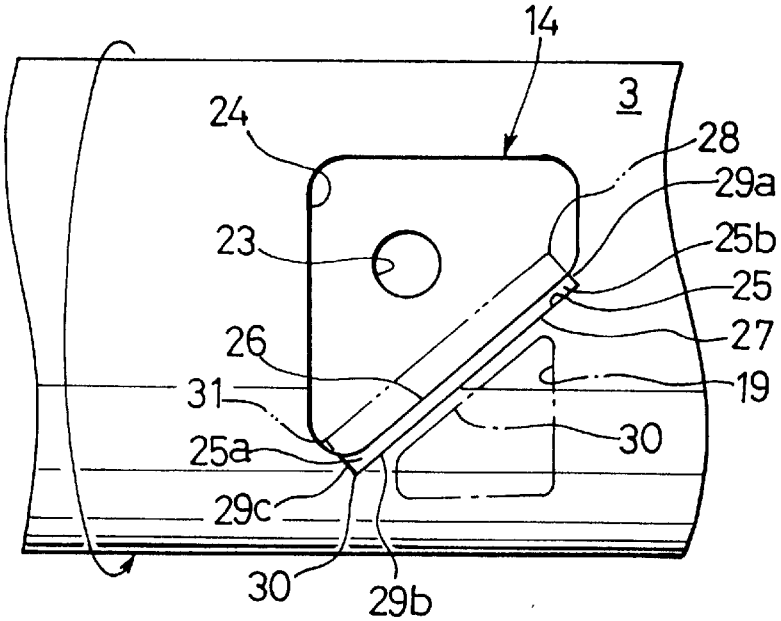
Figure 3:
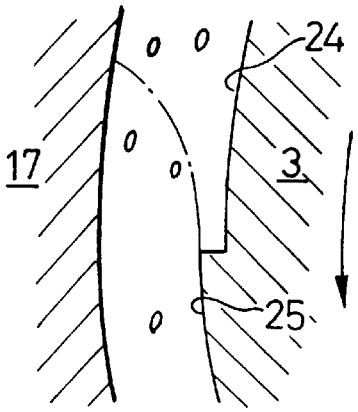
FIG. 3 is a cross section showing the vicinity of a corner area of the inflow/outflow port shown in FIG. 2.

In this embodiment, two plungers 8, for instance (or four plungers) are provided over 180° intervals (or 90° intervals) on the same plane. At the base end portion of the rotor 3 that links with the drive shaft, the plungers 8 are inserted slidably in the direction of the radius (radial direction), as shown in FIGS. 2A and 2B. In this structural example, four plungers 8 are provided on the same plane over 90° intervals. The front end of each of the plungers 8 blocks off and faces a compression space 9 which is provided at the center of the base end portion of the rotor 3. The base end of each plunger 8 slides in contact with the internal surface of a ring-like cam ring 12 via a shoe 10 and a roller 11. This cam ring 12 is provided concentrically around the rotor 3, with cam lobes, the number of which corresponds to the number of cylinders in the engine, formed on the inside so that when the rotor 3 rotates, each plunger 8 makes reciprocal movement in the direction of the radius of the rotor 3 (radial direction) to vary the volumetric capacity of the compression space 9.

At the rotor 3, a longitudinal hole 13 is formed in the axial direction, communicating with the compression space 9. Inflow/outflow ports 14, which communicate with the longitudinal hole 13, and the number of which corresponds to the number of cylinders, are formed at the circumferential surface of the rotor 3 and a discharge port 16 which allows communication between distribution passages 15 formed at the barrel 5 and the pump housing 4, and the longitudinal hole 13, is formed. In addition, a control sleeve 17 provided in the chamber 2 is externally fitted at the rotor 3 slidably, covering the inflow/outflow ports 14.

At the control sleeve 17, a lateral groove 18*a* extending in the circumferential direction, a longitudinal groove 18 extending parallel to the direction of the axis of the distribution member and a communicating hole 19 (indicated by the one-point chain line in FIG. 2) which can come into communication with the inflow/outflow ports 14 of the rotor 3 are formed. A decentered connecting portion provided at the shaft of an electric governor (not shown) is made to connect with the lateral groove 18*a* at the control sleeve 17, and when the shaft of the electric governor is caused to rotate, the control sleeve 17 is caused to become displaced relative to the axial direction of the rotor 3. In addition, a retaining portion 22 of a link member 21 which interlocks with the cam ring 12 while maintaining a specific relationship is retained at the longitudinal groove 18, and when the cam ring 12 is caused to rotate by a timer device, the control sleeve 17, too, is caused to rotate in the same direction while maintaining a specific relationship.

Thus, when the rotor 3 rotates, the plungers 8 make reciprocal movement in the direction of the radius of the rotor 3 and the inflow/outflow ports 14, come into communication with the communicating hole 19 of the control sleeve 17 sequentially and, in an intake phase, during which the plungers 8 move away from the center of the cam ring 12, an inflow/outflow ports 14 and the communicating hole 19 become aligned to allow the fuel to be taken into the compression space 9 from the chamber 2. Then, when the operation enters the force-feed phase, during which the plungers 8 move toward the center of the cam ring 12, the communication between the inflow/outflow ports 14 and the communicating hole 19 is cut off, the discharge port 16 and one of the fuel distribution passages 15 become aligned and compressed fuel is delivered from a delivery valve via this fuel distribution passage 15. After this, the fuel delivered from a the delivery valve is sent to an injection nozzle via an injection pipe to be injected into a cylinder of the engine from the injection nozzle. Then, when the next inflow/outflow ports 14 comes into communication with the communicating hole 19 during the force-feed phase, the compressed fuel flows out into the chamber 2 to radically reduce the fuel pressure of the fuel delivered to the injection nozzle, thereby ending the injection.

The inflow/outflow ports 14 formed at the rotor 3 fulfill two functions, i.e., the function of intake ports for the inflow of fuel and the function of cutoff ports for the cutting off of the flow of fuel, and an enlargement of this is shown in FIG. 2A. Each inflow/outflow port 14 comprises a fuel passage hole 23 which connects to the longitudinal hole 13 and is bored in a radial direction relative to the rotor, a pond-like indented portion 24 spread on the external circumferential surface of the rotor 3 and around this fuel passage hole 23, and a reed-like indented portion 25 which is formed continuously from the pond-like indented portion 24. The pond-like indented portion 24 comprises a first groove segment 24*a* which extends in the circumferential direction and a second groove segment 24*b* which is formed continuous to the first groove segment 24*a* at a specific angle toward the front side relative to the direction of rotation, and as a whole, has roughly the shape of the letter "L."

The reed-like indented portion 25 is provided at the front end portion of the second groove segment 24*b* in the direction of rotation, i.e. along the oblique side 26 of the second groove segment 24*b* to the front relative to the direction of rotation. This reed-like indented portion 25 is machined later in order to accurately form a spill start edge 27 on the external circumferential surface, on which the pond-like indented portion 24 already exists, using a circular cutter of a specific width to cut it at approximately the same angle as that of the second groove segment 24*b*. The depth of the cut is less than that of the pond-like indented portion 24 and both end portions 25*a* and 25*b* of the reed-like indented portion 25 that constitute the starting and finishing edges of the cut are cut upward so that they become progressively shallower near the ends.

This reed-like indented portion 25 is formed so that a half or more of its width faces opposite the pond-like indented portion (see two-point chain line). More specifically, the end portion 25*b* on the side near the first groove segment 24*a* is formed in such a manner that corner 28 which is on the rear side relative to the direction of rotation lies within the interference range over which it interferes with the pond-like indented portion 24. Therefore, the only area of the reed-like indented portion 25 which is exposed on the outside extends to the front relative to the direction of rotation from the second groove segment 24*b*. This means that the contour of the reed-like indented portion 25 reaches the frontmost corner portion 31 of the reed-like indented portion 25 by way of a first oblique side 29*a* which is continuous from the contour of the pond-like indented portion 24 and extends toward the front relative to the direction of rotation, and a second oblique side 29*b* which forms a right angle to the first oblique side 29*a* and extends toward the front relative to the direction of rotation.

The end portion 25*a* which is further away from the first groove segment 24*a* extends in such a manner that it protrudes from the pond-like indented portion 24, and is formed in such a manner that the width of the pond-like indented portion 24 in the axial direction and the width of the reed-like indented portion 25 in the axial direction are approximately equal. Consequently, at the end portion 25*a*, too, which protrudes from the second groove segment 24*b*, the contour of the reed-like indented portion 25 reaches the frontmost corner portion 31 by way of a third oblique side 29*c* which is continuous from the contour of the pond-like indented portion 24 and extends toward the front relative to the direction of rotation, and a fourth oblique side 29*d* which forms a right angle to the third oblique side 29*c* and extends toward the front relative to the direction of rotation.

It is to be noted that the communicating hole 19 of the control sleeve 17 is formed in a trapezoidal shape having an inclined edge 30 which is parallel to the spill start edge 27 of the reed-like indented portion 25. The rotor ports described above comprise the inflow/outflow ports 14, the sleeve ports described above comprise the communicating hole 19, the first indented portion comprises the pond-like indented portion 24, the second indented portion comprises the reed-like indented portion 25 and the section facing the front side relative to the direction of rotation, which constitutes the contour of the second indented portion described above, comprises the first through the fourth oblique sides, 29*a* through 29*d*.

In the structure described above, both the pond-like indented portion 24 and the reed-like indented portion 25 are blocked by the internal circumferential surface of the control sleeve 17 during the force-feed phase. As soon as the spill start edge 27 of the reed-like indented portion 25 transverses the inclined edge 30 of the communicating hole 19 formed at the control sleeve 17, the compressed fuel is caused to flow out to the chamber 2 via the communicating hole 19. This cutoff timing, which is when the inflow/outflow ports 14 and the communicating hole 19 come into communication with each other, is adjusted by adjusting the position of the control sleeve 17 in the axial direction, and the injection quantity increases as the control sleeve 17 moves to the right in the drawing and the injection quantity decreases as it moves to the left in the drawing.

Specifically, during the force-feed phase, compressed fuel will collect at the pond-like indented portion 24 and the reed-like indented portion 25, causing the dust particles in the fuel to remain momentarily in these indented portions. However, because the contour of the reed-like indented portion 25 is formed by lines 29*a*~29*d* which extend toward the front relative to the direction of rotation from the contour of the pond-like indented portion 24, the reed-like indented portion 25 is without any corner portion for dust particles to collect in. Although the end portion 5*b* of the reed-like indented portion 25 is cut upward, the dust particles in this portion are readily guided by the first oblique side 29*a* and the like to the pond-like indented portion 24, and will not readily enter the area between the rotor 3 and the control sleeve 17. Thus, the risk of the sliding contact surfaces being scarred from dust particles entering between the sliding contact surface of the rotor 3 and the sliding contact surface of the control sleeve 17 is reduced, and the risk of seizure is also reduced. Furthermore, because the likelihood of scars and seizure occurring is reduced, the clearance between the rotor 3 and the control sleeve 17 can be reduced to improve control precision and injection performance.

The shape of the pond-like indented portion 24 is not limited to the shape described above, as long as it communicates with the communicating hole 19 over a specific range of rotation angle. For instance, the same advantages would be achieved if it were formed in a roughly trapezoidal shape, as shown in FIG. 2B. More specifically, in this example, both the end portions 25*a* and 25*b* of the reed-like indented portion 25 are formed in such a manner as to position the corners 28 and 31 of the rear side relative to the direction of rotation within the interference range with the pond-like indented portion 24. The section extending from the end portion to the rear of the direction of rotation to the frontmost corner portion 31 comprises a first oblique side 29*a* which is continuous from the contour of the pond-like indented portion 24 and extends toward the front relative to the direction of rotation, and a second oblique side 29*b* which forms a right angle to the first oblique side 29*a* and extends toward the front relative to the direction of rotation. The side extending from the end portion to the front relative to the direction of rotation to the frontmost corner portion 31 comprises only a third oblique side 29*c* which is continuous from the contour of the pond-like indented portion 24 and extends toward the front relative to the direction of rotation.

Furthermore, even in the structure described above, as long as the corner portion 28 is formed in such a manner that it does not protrude from the pond-like indented portion 24, the other corner portion 31 need not be kept within the range of the pond-like indented portion 24 and can be formed as shown in FIG. 2A.

Figure 4A:
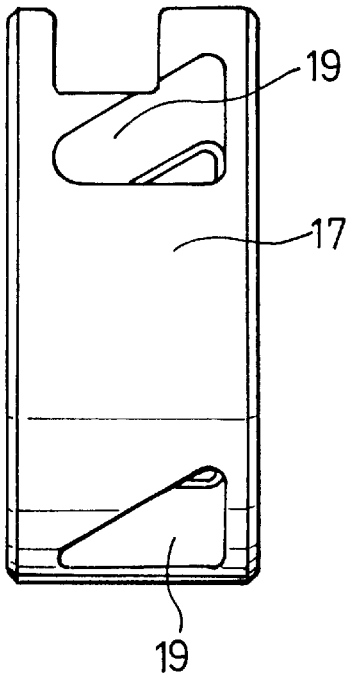
FIG. 4A shows the control sleeve in another structural example.
Figure 4B:
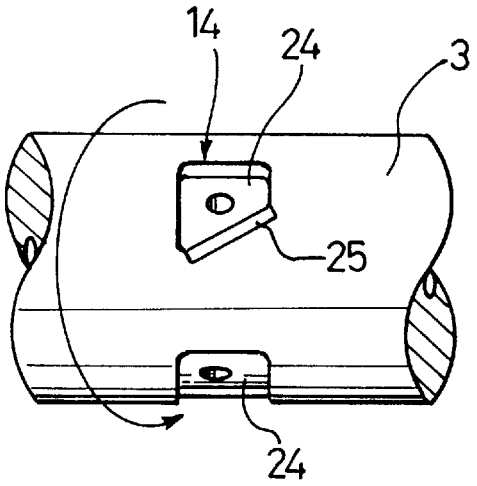
FIG. 4B shows the vicinity of the inflow/outflow ports of the rotor.
Figure 5:
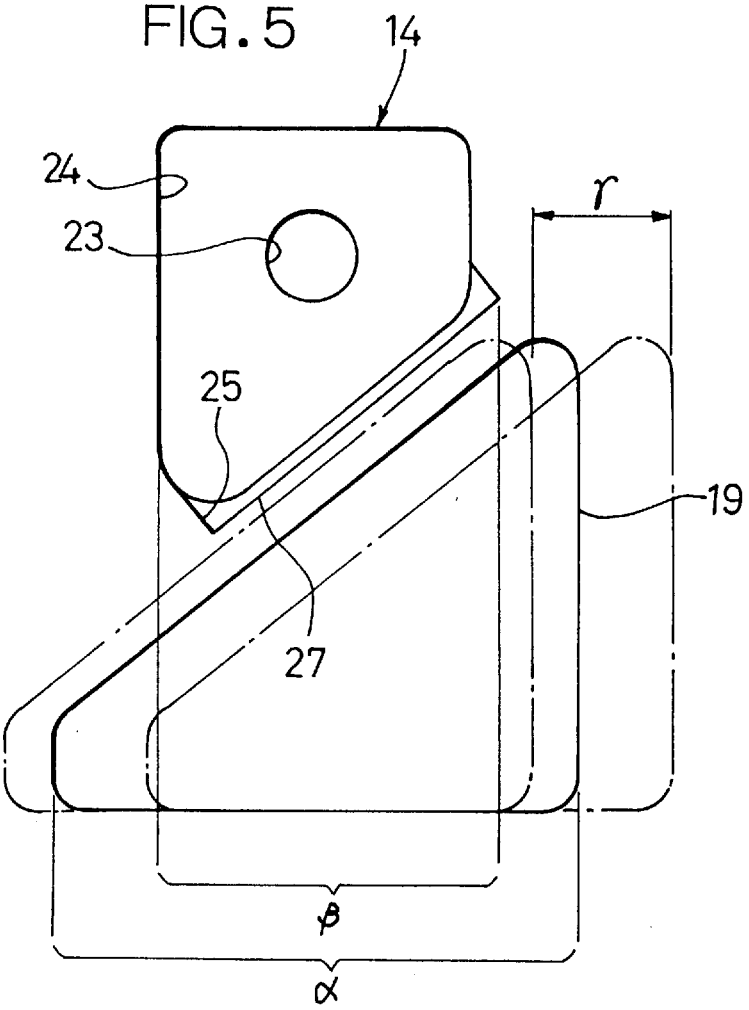
FIG. 5 illustrates the relationship between a communicating hole formed at a control sleeve and the inflow/outflow port formed at the rotor, both shown in FIGS. 4A and 4B.
Figure 6A:
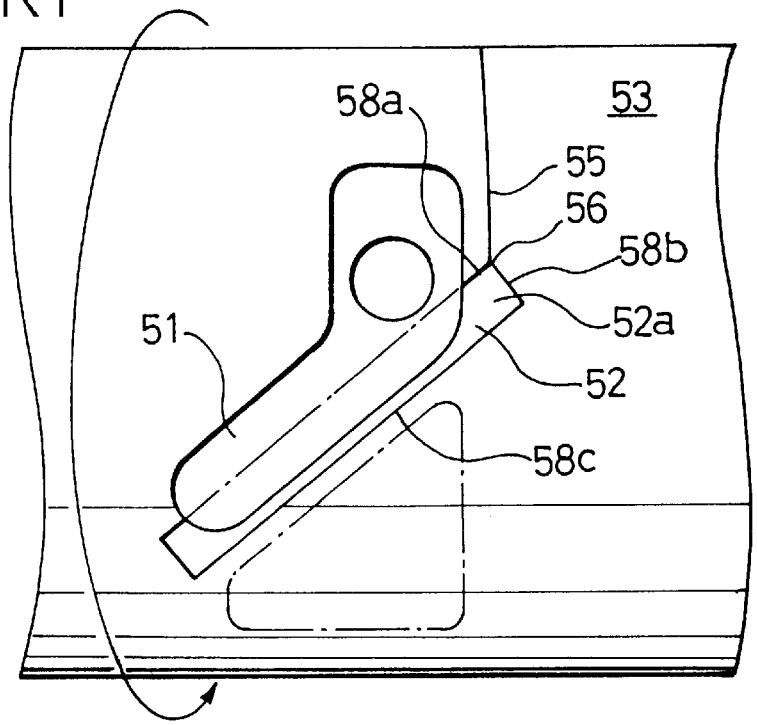
FIG. 6A PRIOR ART
FIG. 6A is an enlargement showing the vicinity of an inflow/outflow port of a conventional rotor and FIG. 6B is a cross section of the vicinity of a corner area of the inflow/outflow port shown in FIG. 6A.
Figure 6B:
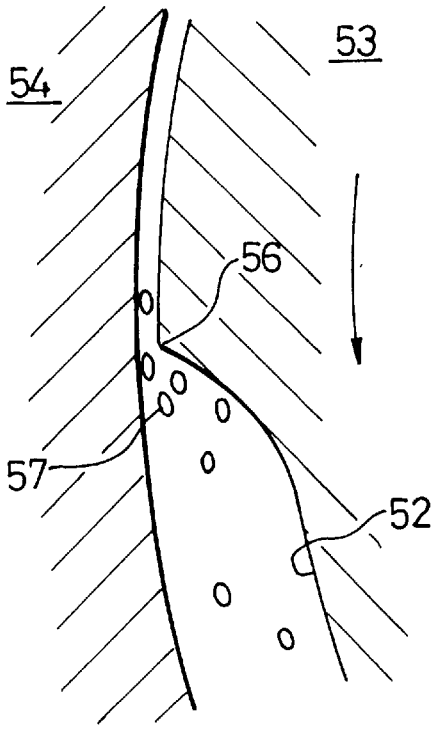
FIG. 6B PRIOR ART
Figure 7A:
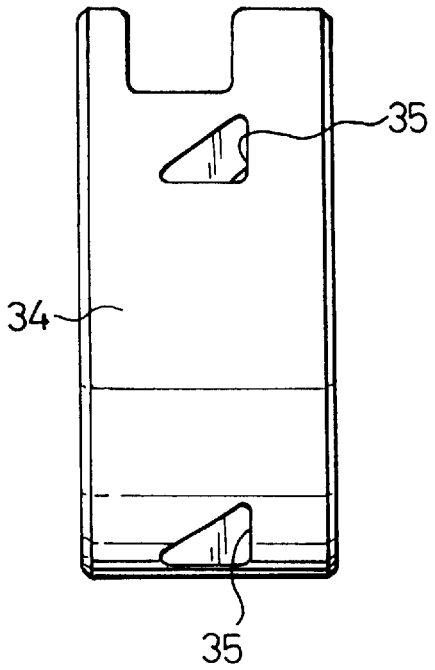
FIG. 7A PRIOR ART
FIG. 7A shows a conventional control sleeve.
Figure 7B:
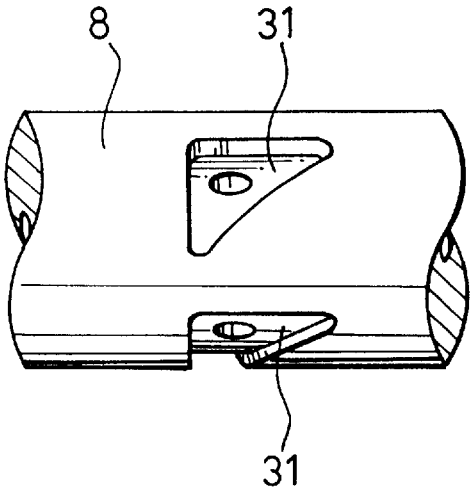
FIG. 7B PRIOR ART
FIG. 7B illustrates the vicinity of an inflow/outflow port of a conventional rotor.
Figure 8:
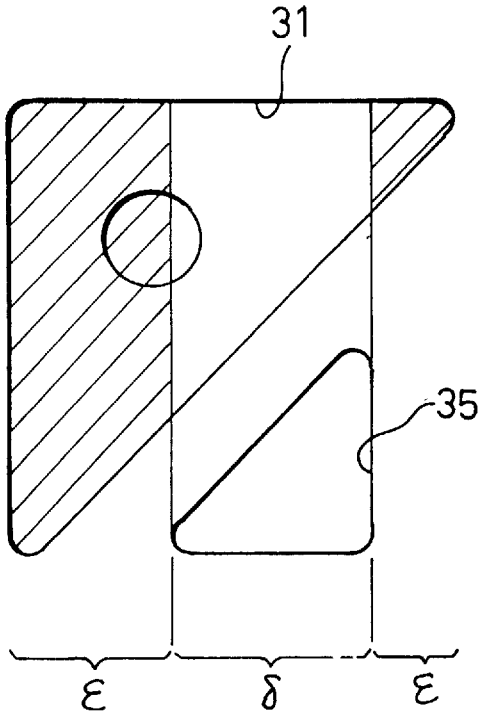
FIG. 8 PRIOR ART
FIG. 8 illustrates the relationship between an intake/cutoff ports formed at the control sleeve and an inflow/outflow port formed at the rotor.

FIGS. 4A and 4B shows a variant of the structure described above. This variant is the same as the structure described above in that the pond-like indented portion 24 and the reed-like indented portion 25 are formed at the rotor 3, as illustrated in FIG. 2B. The characteristic feature of this structure is that the width ($\alpha$) in the axial direction is set larger than the width ($\beta$) in the axial direction of the spill port 14 ($\alpha>\beta$).

The number of communicating holes 19 formed at the circumference of the control sleeve 17 corresponds to the number of cylinders. Their cross-section is roughly triangular in shape and their oblique sides are parallel to the spill start edges 27 of the inflow/outflow ports 14. In addition, the width ($\alpha$) of the communicating hole 19 in the axial direction is set so that an inflow/outflow port 14 will not be offset from the communicating hole 19 regardless of the position of the control sleeve 17 ($\alpha>\beta+\gamma$) by anticipating the range over which the control sleeve 17 is caused to move in the direction of the axis of the rotor 3. Since the same reference numbers are assigned to identical components, their explanation is omitted.

According to this structure, since the reed-like indented portion 25 of the inflow/outflow ports 14 is configured as described above, in addition to having the same advantages as those described above, the dust particles in the fuel will not remain in the pond-like indented portion 24 or the reed-like indented portion 25, with the locus of the inflow/outflow port 14 moved through the rotation of the rotor 3 always contained within the range of the communicating hole 19 and no portion formed at the inflow/outflow port 14 that does not face the communicating hole 19. Therefore, the risk of dust particles entering between the sliding contact surfaces of the rotor 3 and the control sleeve 17 is reduced to achieve a similar effect to the structural example described above.

By making the communicating holes 19 larger than the inflow/outflow ports 14, the area on the control sleeve 17 occupied by the communicating holes 19 increases proportionately, creating some concern as to how this will affect the strength of the control sleeve 17. However, since the inflow/outflow ports 14 are open in their entirety to the communicating holes 19 and no blocked space is created, unlike in the prior art, the pressure of the fuel will have no significant effect on the thin portions of the control sleeve, posing no problem in terms of its strength.

As has been explained, according to the present invention, with regard to forming a second indented portion continuous toward the front end of a first indented portion in the direction of rotation, no corner portion is formed at the second indented portion in which dust particles can readily collect, since the contour of the second indented portion is constituted of sides extending toward the front relative to the direction of rotation from the contour of the first indented portion. Therefore, if dust particles enter the second indented portion, this dust particles will not collect in the second indented portion but will move quickly to the first indented portion located towards the rear in the direction of rotation, reducing the possibility of dust particles entering between the rotor and the sleeve and scarring their sliding contact surfaces, and of seizure. In addition, since the entry of dust particles between the sliding contact surfaces can be reduced, the clearance between the rotor and the sleeve can be reduced to improve fuel injection performance and stabilize the fuel injection quantity even at low speed operation.

In addition, according to the present invention, since the length of the rotor port in the axial direction is set smaller than the length of the sleeve ports in the axial direction, the locus of the rotor port will be contained within the range of the sleeve ports. As a result, no blocked-off portion is created at the rotor ports that does not face the sleeve ports and thus the frequency of dust particles entering between the rotor and the sleeve is reduced. Consequently, in this instance too, scarring and seizure at the sliding contact surfaces is inhibited, making it possible to reduce the clearance.

What is claimed is:

1. A spill control apparatus for a fuel injection system constituted by:

externally fitting a sleeve on a rotor slidably, providing a force feed fuel passage for supplying compressed fuel, a discharge port, and rotor ports which connect with said force feed fuel passage and open onto the external circumferential surface of said rotor covered by said sleeve, forming sleeve ports capable of communicating with said rotor ports on said sleeve to adjust the communication timing with which said rotor port and said sleeve ports communicate by the displacement of said sleeve relative to said rotor, wherein:

either each of said rotor ports or said sleeve ports is constituted of:

a first indented portion which is formed on a sliding contact surface where said rotor and said sleeve slide in contact and communicates with a port at another side, i.e., either at said rotor or said sleeve, over a specific angle of rotation and, a second indented portion which is formed at said sliding contact surface where said rotor and said sleeve slide in contact and determines said communication timing with said port at another side;

said first indented portion and second said indented portion are continuously formed so that, said second indented portion is positioned further toward the front side relative to the direction of rotation than said first indented portion; and, the contour of said second indented portion is constituted only of sides which extend continuously from the contour of said first indented portion toward the front relative to said direction of rotation.

2. A spill control apparatus for a fuel injection system according to claim 1, wherein:

said second indented portion is a groove formed in alignment with a side of said first indented portion that is inclined relative to the axis of said rotor.

3. A spill control apparatus for a fuel injection system according to claim 2, wherein:

of said contour of said second indented portion constituted only of said sides that extend toward said front side in said direction of rotation continuous from said contour of said first indented portion, the section that reaches the frontmost end from an end of said second indented portion to the rear in the direction of rotation is constituted of a first oblique side which extends toward said front side relative to the direction of rotation from said first indented portion and a second oblique side which forms a right angle to said first oblique side and extends toward the front relative to the direction of rotation, and the section that reaches the frontmost end from an end of said second indented portion to the front relative to the direction of rotation comprises a third oblique side which extends toward the front relative to the direction of rotation from said first indented portion and a fourth oblique side which extends at a right angle to said third oblique side and extends toward the front relative to the direction of rotation.

4. A spill control apparatus for a fuel injection system according to claim 2, wherein:

of said contour of said second indented portion constituted only of said sides that extend toward said front side in said direction of rotation continuous from said contour of said first indented portion, the section that reaches the frontmost end from an end of said second indented portion to the rear in the direction of rotation is constituted of a first oblique side which extends toward said front side relative to the direction of rotation from said first indented portion and a second oblique side which forms a right angle to said first oblique side and extends toward the front relative to the direction of rotation, and the section that reaches the frontmost end from an end of said second indented portion at the front relative to the direction of rotation is constituted of a third oblique side which extends toward the front relative to the direction of rotation continuous from said contour of said first indented portion.

5. A spill control apparatus for a fuel injection system according to claim 2, wherein:

the length of said second indented portion in the axial direction of said rotor is formed approximately equal to the length of said first indented portion in said axial direction of said rotor and two end portions of said second indented portion are approximately aligned with two end portions in said axial direction of said first indented portion.

6. A spill control apparatus for a fuel injection system according to claim 1, wherein:

end portions of said second indented portion to the rear relative to the direction of rotation and to the front relative to the direction of rotation become progressively shallower toward the ends.

7. A spill control apparatus for a fuel injection system according to claim 1, wherein:

said second indented portion is formed shallower than said first indented portion.

8. A spill control apparatus for a fuel injection system according to claim 1, wherein:

an edge of said second indented portion which starts communication with said a port at another side, i.e., either at said rotor or said sleeve, is formed parallel with a corresponding edge of said port at another side.

9. A spill control apparatus for a fuel injection system constituted by:

externally fitting a sleeve on a rotor slidably, providing a force feed fuel passage for supplying compressed fuel, a discharge port, and a rotor port which connects with said force feed fuel passage and open onto the external circumferential surface of said rotor covered by said sleeve, forming a sleeve port capable of communicating with said rotor ports on said sleeve to adjust the communication timing with which said rotor port and said sleeve port communicate by the displacement of said sleeve relative to said rotor, wherein:

said rotor port is constituted of:

a first indented portion which is formed on a sliding contact surface where said rotor and said sleeve slide in contact and communicates with said sleeve port over a specific angle of rotation and, a second indented portion which is formed at said sliding contact surface where said rotor and said sleeve slide in contact and determines said communication timing with said sleeve port;

said first indented portion and second indented portion are continuously formed so that, said second indented portion is positioned further toward the front side relative to the direction of rotation than said first indented portion;

the contour of said second indented portion is constituted only of sides which extend continuously from the contour of said first indented portion toward the front relative to said direction of rotation; and the length, in the axial direction, of said rotor port formed at said external circumferential surface of said rotor is set smaller than the length, in the axial direction, of said sleeve ports formed at the internal circumferential surface of said sleeve.

10. A spill control apparatus for a fuel injection system according to claim 9, wherein:

said length, in said axial direction, of said sleeve ports at said internal circumferential surface of said sleeve is set at a length such that it includes the locus of said rotor port, regardless of the relative displacement of said sleeve and said rotor in the axial direction.

11. A spill control apparatus for a fuel injection system according to claim 9, wherein:

said second indented portion is a groove formed in alignment with the side of said first indented portion that is inclined relative to the axis of said rotor.

12. A spill control apparatus for a fuel injection system according to claim 11, wherein:

of said contour of said second indented portion constituted only of said sides that extend toward said front side in said direction of rotation continuous from said contour of said first indented portion, the section that reaches the frontmost end from an end of said second indented portion to the rear in the direction of rotation is constituted of a first oblique side which extends toward said front side relative to the direction of rotation from said first indented portion and a second oblique side which forms a right angle to said first oblique side and extends toward the front relative to the direction of rotation, and the section that reaches the frontmost end from an end of said second indented portion to the front relative to the direction of rotation comprises a third oblique side which extends toward the front relative to the direction of rotation from said first indented portion and a fourth oblique side which extends at a right angle to said third oblique side and extends toward the front relative to the direction of rotation.

13. A spill control apparatus for a fuel injection system according to claim 11, wherein:

of said contour of said second indented portion constituted only of said sides that extend toward said front side in said direction of rotation continuous from said contour of said first indented portion, the section that reaches the frontmost end from an end of said second indented portion to the rear in the direction of rotation is constituted of a first oblique side which extends toward said front side relative to the direction of rotation from said first indented portion and a second oblique side which forms a right angle to said first oblique side and extends toward the front relative to the direction of rotation, and the section that reaches the frontmost end from an end of said second indented portion at the front relative to the direction of rotation is constituted of a third oblique side which extends toward the front relative to the direction of rotation continuous from said the contour of said first indented portion.

14. A spill control apparatus for a fuel injection system according to claim 11, wherein:

the length of said second indented portion in the axial direction of said rotor is formed approximately equal to the length of said first indented portion in said axial direction of said rotor and two end portions of said second indented portion are approximately aligned with two end portions in said axial direction of said first indented portion.

15. A spill control apparatus for a fuel injection system according to claim 9, wherein:

end portions of said second indented portion to the rear relative to the direction of rotation and to the front relative to the direction of rotation become progressively shallower toward the ends.

16. A spill control apparatus for a fuel injection system according to claim 9, wherein:

said second indented portion is formed shallower than said first indented portion.

17. A spill control apparatus for a fuel injection system according to claim 9, wherein:

an edge of said second indented portion which starts communication with said sleeve port, is formed parallel with a corresponding edge of said port at another side.

* * * * *